US006606077B2

(12) United States Patent
Ebling et al.

(10) Patent No.: US 6,606,077 B2
(45) Date of Patent: Aug. 12, 2003

(54) MULTI-BEAM ANTENNA

(75) Inventors: James P. Ebling, Ann Arbor, MI (US); Gabriel Rebeiz, Ann Arbor, MI (US)

(73) Assignee: Automotive Systems Laboratory, Inc., Farmington Hills, MI (US)

( * ) Notice: Subject to any disclaimer, the term of this patent is extended or adjusted under 35 U.S.C. 154(b) by 0 days.

(21) Appl. No.: 10/202,242

(22) Filed: Jul. 23, 2002

(65) Prior Publication Data

US 2003/0006941 A1 Jan. 9, 2003

Related U.S. Application Data

(63) Continuation-in-part of application No. 09/716,736, filed on Nov. 20, 2000, now Pat. No. 6,424,319.
(60) Provisional application No. 60/166,231, filed on Nov. 18, 1999.

(51) Int. Cl.[7] ..... H01Q 15/02; H01Q 15/08
(52) U.S. Cl. ..... 343/911 L; 343/909; 343/753
(58) Field of Search ..... 343/909, 911 L, 343/754, 753, 911 R, 853, 755; H01Q 15/02, 15/08

(56) References Cited

U.S. PATENT DOCUMENTS

| | | | | | |
|---|---|---|---|---|---|
| 3,761,936 | A | | 9/1973 | Archer et al. | 343/754 |
| 3,972,043 | A | * | 7/1976 | Locus | 343/756 |
| 4,222,054 | A | | 9/1980 | Capps | 343/754 |
| 4,268,831 | A | | 5/1981 | Valentino et al. | 343/754 |
| 4,288,795 | A | | 9/1981 | Shelton | 343/754 |
| 4,638,322 | A | | 1/1987 | Lamberty | 343/761 |
| 4,641,144 | A | | 2/1987 | Prickett | 343/754 |
| 4,845,507 | A | | 7/1989 | Archer et al. | 343/754 |
| 4,983,237 | A | | 1/1991 | Alfing | 156/83 |
| 5,099,253 | A | | 3/1992 | Archer | 343/754 |
| 5,204,686 | A | | 4/1993 | Petrelis et al. | 342/374 |
| 5,274,389 | A | | 12/1993 | Archer et al. | 343/754 |
| 5,347,287 | A | | 9/1994 | Speciale | 342/375 |
| 5,451,969 | A | | 9/1995 | Toth et al. | 343/781 CA |
| 5,548,294 | A | | 8/1996 | Sturza | 342/372 |
| 5,576,721 | A | | 11/1996 | Hwang et al. | 343/753 |
| 5,712,643 | A | | 1/1998 | Skladany | 343/700 MS |
| 5,745,082 | A | * | 4/1998 | Alder | 343/753 |
| 5,821,908 | A | | 10/1998 | Sreenivas | 343/911 R |
| 5,828,344 | A | * | 10/1998 | Alder et al. | 343/755 |
| 5,874,915 | A | | 2/1999 | Lee et al. | 342/375 |
| 5,892,487 | A | | 4/1999 | Fujimoto et al. | 343/840 |
| 5,894,288 | A | | 4/1999 | Lee et al. | 343/770 |
| 5,913,549 | A | | 6/1999 | Skladany | 29/600 |
| 5,926,134 | A | | 7/1999 | Pons et al. | 342/368 |
| 6,031,501 | A | | 2/2000 | Rausch et al. | 343/754 |
| 6,046,703 | A | | 4/2000 | Wang et al. | 343/795 |
| 6,061,035 | A | | 5/2000 | Kinasewitz et al. | 343/853 |
| 6,424,319 | B2 | * | 7/2002 | Ebling et al. | 343/911 L |

OTHER PUBLICATIONS

G. Bekefi, and G. W. Farnell, "A homogenous dielectric sphere as a mi–crowave lens," Canadian Journal of Physics, vol. 34, pp. 790–803, 1956.

(List continued on next page.)

*Primary Examiner*—Hoanganh Le
(74) *Attorney, Agent, or Firm*—Dinnin & Dunn.P.C.

(57) ABSTRACT

A multi-beam antenna comprises an electromagnetic lens, at least one first antenna feed element, at least one second antenna feed element, and a selective element located between first and second portions of the electromagnetic lens with which the respective antenna feed elements respectively cooperate. The transmissivity and reflectivity of the selective element are responsive to an electromagnetic wave property, e.g. frequency or polarization. A first electromagnetic wave in cooperation with the at least one first antenna feed element and having a first value of the electromagnetic wave property is substantially transmitted through the selective element so as to propagate in both the first and second portions of the electromagnetic lens. A second electromagnetic wave in cooperation with the at least one second antenna feed element and having a second value of the electromagnetic wave property is substantially reflected by the selective element.

27 Claims, 10 Drawing Sheets

OTHER PUBLICATIONS

G. Toraldo di Francia, "Spherical lenses for infrared and microwaves," Journal of Applied Physics, vol. 32, pp. 2051, 1961.

T.L. Ap Rhys, "The design of radially symmetric lenses," IEEE Trans. on Antennas and Propagation, AP–18, pp. 497–506, Jul. 1970.

L. C. Gunderson, "An electromagnetic analysis of a cylindrical homoge–nous lens," IEEE Trans. on Antennas and Propagation, AP–20, pp. 476–479, Jul. 1972.

S. Lee, M. S. Sheshadri, V. Jamnejad, and R. Mittra, "Refraction at a curved dielectric interface: geometrical optics solution," IEEE Trans. on Microwave Theory and Techniques, MTT–30, No. 1, pp. 12–19, Jan. 1982.

M. N. Afsar, "Dielectric measurements of common polymers at millimeter wavelength range," in IEEE MTT–S Digest, pp. 439–442, 1985.

J. Ahkenazy, E. Levine, and D. Treves, "Radiometric measurement of antenna efficiency," in Electron. Lett., vol. 21, No. 3, pp. 111–112, Jan 1985.

K. S. Yngvesson, T. L. Korzeniowski, Y. S. Kim, E. L. Kollberg, and J. F. Johansson, "The tapered slot antenna—a new integrated element for mm–wave applications," IEEE Trans. on Microwave Theory and Techniques, MTT–37, No. 2, pp. 365–374, Feb. 1989.

J. Sanford, "A luneberg–lens update," IEEE Antennas and Propagation Magazine, vol. 37, No. 1, pp. 76–79, 1995.

S. Sugawara, Y. Maita, K. Adachi, K. Mori, and K. Mizuno, "A mm–wave tapered slot antenna with improved radiation pattern," in 1997 IEEE MTT–S Int. Microwave Symp. Dig., Anaheim, CA, Jun. 1997, pp. 959–962.

K. K. Chan, S. K. Rao, G. A. Morin, and M. Q. Tang, "Triangular ray–tube analysis of dielectric lens antennas," IEEE Trans. on Antennas and Propagation, vol. 45, No. 8, pp. 1277–1285, Aug 1997.

F. Demmerle, S. Kern, and W. Wiesbeck, "A bi–conical multibeam antenna for space division multiple access," in Antennas and Propagation Society International Symposium, Montreal, Aug 1997, pp. 1082–1085.

H. Mosallaei, and Yahya Rahmat–Samii "Nonuniform luneburg and two–shell lens antennas: radiation characteristics and design optimization," IEEE Trans. on Antennas and Propagation, vol. 49, No. 1, pp. 60–68, Jan 2001.

I. Gresham, N. Jain, T. Budka, A. Alexanian, N. Kinayman, B. Ziegner, S. Brown, and P. Staecker, "A compact manufactureable 76–77–GHz radar module for commercial ACC applications," IEEE Trans. on Microwave Theory and Techniques, vol. 49, No. 1, pp. 44–58, Jan 2001.

B. Schoenlinner; X. Wu; G.V. Eleftheriades; G.M. Rebeiz, "Spherical–Lens Antennas for Millimeter Wave Radars", European Microwave Week 2001 Proc., pp. 317–320, vol. 3, Sep., 2001.

B. Schoenlinner; G.M. Rebeiz, "Compact Multibeam Imageing Antenna for Automotive Radars", 2002 IEEE MTT–S Digest, pp. 1373–1376, Jun. 2002.

B. Schoenlinner; X. Wu; J.P. Ebling; G.V. Eleftheriades; G.M. Rebeiz, "Wide–Scan Spherical–Lens Antennas for Automotive Radars", IEEE Transactions on Microwave Theory and Techniques, vol. 50, No. 9, Sep. 2002.

* cited by examiner

MULTI-BEAM ANTENNA

CROSS-REFERENCE TO RELATED APPLICATIONS

The instant application is a continuation-in-part of U.S. application Ser. No. 09/716,736 filed Nov. 20, 2000, U.S. Pat. No. 6,424,319, which claims the benefit of prior U.S. Provisional Application Ser. No. 60/166,231 filed on Nov. 18, 1999, all of which are incorporated herein by reference.

DETAILED DESCRIPTION OF EMBODIMENT(S)

Figure 1:
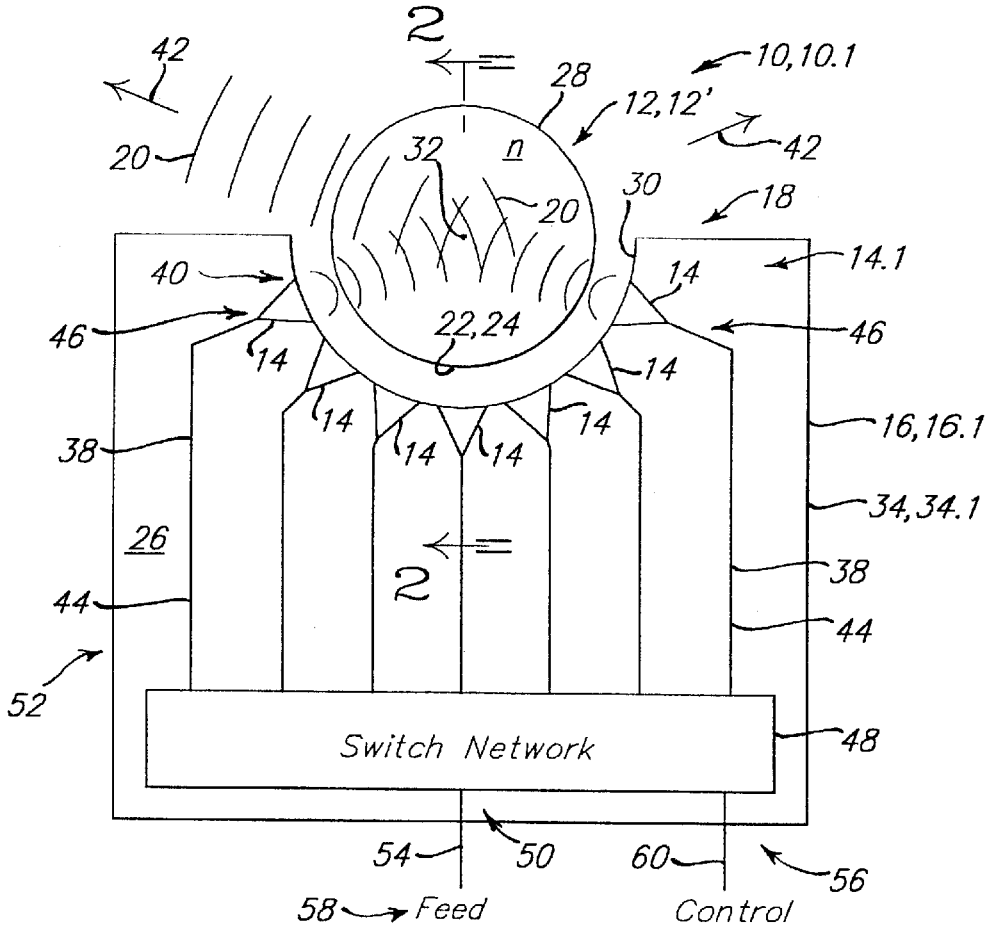
FIG. 1 illustrates a top view of a first embodiment of a multi-beam antenna comprising an electromagnetic lens.
Figure 2:
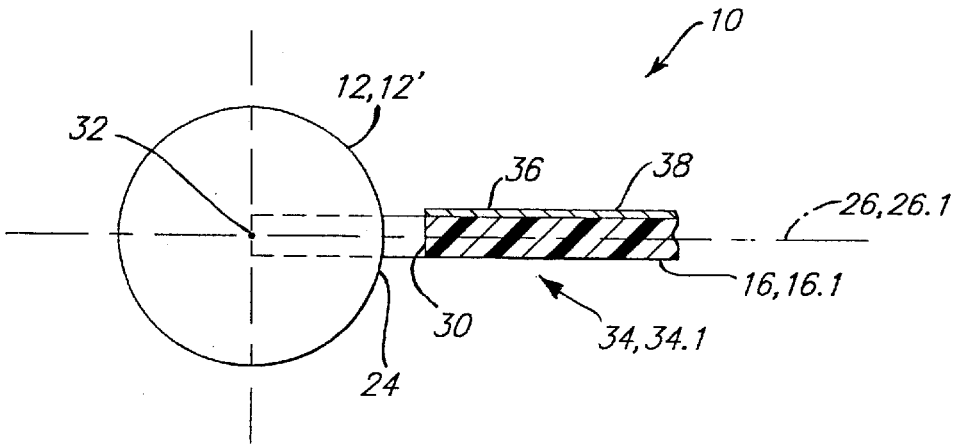
FIG. 2 illustrates a side cross-section of the embodiment of FIG. 1.

Referring to FIGS. 1 and 2, a multi-beam antenna 10, 10.1 comprises at least one electromagnetic lens 12 and a plurality of antenna feed elements 14 on a dielectric substrate 16 proximate to a first edge 18 thereof, wherein the plurality of antenna feed elements 14 are adapted to radiate a respective plurality of beams of electromagnetic energy 20 through the at least one electromagnetic lens 12.

Figure 3:
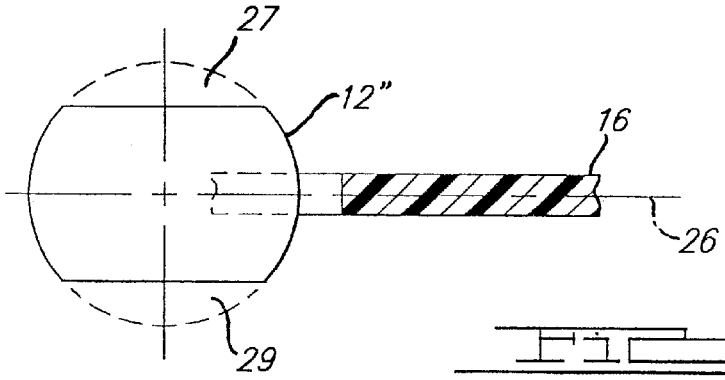
FIG. 3 illustrates a side cross-section of the embodiment of FIG. 1 incorporating a truncated electromagnetic lens.

The at least one electromagnetic lens 12 has a first side 22 having a first contour 24 at an intersection of the first side 22 with a reference surface 26, for example, a plane 26.1. The at least one electromagnetic lens 12 acts to diffract the electromagnetic wave from the respective antenna feed elements 14, wherein different antenna feed elements 14 at different locations and in different directions relative to the at least one electromagnetic lens 12 generate different associated beams of electromagnetic energy 20. The at least one electromagnetic lens 12 has a refractive index n different from free space, for example, a refractive index n greater than one (1). For example, the at least one electromagnetic lens 12 may be constructed of a material such as REXOLITE™, TEFLON™, polyethylene, or polystyrene; or a plurality of different materials having different refractive indices, for example as in a Luneburg lens. In accordance with known principles of diffraction, the shape and size of the at least one electromagnetic lens 12, the refractive index n thereof, and the relative position of the antenna feed elements 14 to the electromagnetic lens 12 are adapted in accordance with the radiation patterns of the antenna feed elements 14 to provide a desired pattern of radiation of the respective beams of electromagnetic energy 20 exiting the second side 28 of the at least one electromagnetic lens 12. Whereas the at least one electromagnetic lens 12 is illustrated as a spherical lens 12' in FIGS. 1 and 2, the at least one electromagnetic lens 12 is not limited to any one particular design, and may, for example, comprise either a spherical lens, a Luneburg lens, a spherical shell lens, a hemispherical lens, an at least partially spherical lens, an at least partially spherical shell lens, a cylindrical lens, or a rotational lens. Moreover, one or more portions of the electromagnetic lens 12 may be truncated for improved packaging, without significantly impacting the performance of the associated multi-beam antenna 10, 10.1. For example, FIG. 3 illustrates an at least partially spherical electromagnetic lens 12" with opposing first 27 and second 29 portions removed therefrom.

Figure 4:
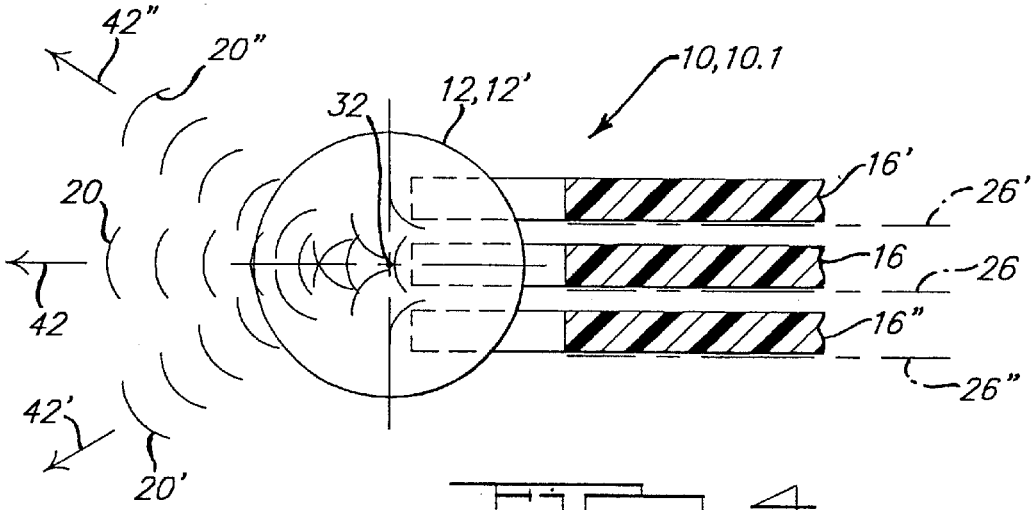
FIG. 4 illustrates a side cross-section of an embodiment illustrating various locations of a dielectric substrate, relative to an electromagnetic lens.

The first edge 18 of the dielectric substrate 16 comprises a second contour 30 that is proximate to the first contour 24. The first edge 18 of the dielectric substrate 16 is located on the reference surface 26, and is positioned proximate to the first side 22 of one of the at least one electromagnetic lens 12. The dielectric substrate 16 is located relative to the electromagnetic lens 12 so as to provide for the diffraction by the at least one electromagnetic lens 12 necessary to form the beams of electromagnetic energy 20. For the example of a multi-beam antenna 10 comprising a planar dielectric substrate 16 located on reference surface 26 comprising a plane 26.1, in combination with an electromagnetic lens 12 having a center 32, for example, a spherical lens 12'; the plane 26.1 may be located substantially close to the center 32 of the electromagnetic lens 12 so as to provide for diffraction by at least a portion of the electromagnetic lens 12. Referring to FIG. 4, the dielectric substrate 16 may also be displaced relative to the center 32 of the electromagnetic lens 12, for example on one or the other side of the center 32 as illustrated by dielectric substrates 16' and 16", which are located on respective reference surfaces 26' and 26".

The dielectric substrate 16 is, for example, a material with low loss at an operating frequency, for example, DUROID™, a TEFLON™ containing material, a ceramic material, or a composite material such as an epoxy/fiberglass composite. Moreover, in one embodiment, the dielectric substrate 16 comprises a dielectric 16.1 of a circuit board 34, for example, a printed circuit board 34.1 comprising at least one conductive layer 36 adhered to dielectric substrate 16, from which the antenna feed elements 14 and other associated circuit traces 38 are formed, for example, by subtractive technology, for example, chemical or ion etching, or stamping; or additive techniques, for example, deposition, bonding or lamination.

The plurality of antenna feed elements 14 are located on the dielectric substrate 16 along the second contour 30 of the first edge 18, wherein each antenna feed element 14 comprises a least one conductor 40 operatively connected to the dielectric substrate 16. For example, at least one of the antenna feed elements 14 comprises an end-fire antenna element 14.1 adapted to launch or receive electromagnetic waves in a direction 42 substantially towards or from the first side 22 of the at least one electromagnetic lens 12, wherein different end-fire antenna elements 14.1 are located at different locations along the second contour 30 so as to launch or receive respective electromagnetic waves in different directions 42. An end-fire antenna element 14.1 may, for example, comprise either a Yagi-Uda antenna, a coplanar horn antenna (also known as a tapered slot antenna), a Vivaldi antenna, a tapered dielectric rod, a slot antenna, a dipole antenna, or a helical antenna, each of which is capable of being formed on the dielectric substrate 16, for example, from a printed circuit board 34.1, for example, by subtractive technology, for example, chemical or ion etching, or stamping; or additive techniques, for example, deposition, bonding or lamination. Moreover, the antenna feed elements 14 may be used for transmitting, receiving or both.

Referring to FIG. 4, the direction 42 of the one or more beams of electromagnetic energy 20 through the electromagnetic lens 12, 12' is responsive to the relative location of the dielectric substrate 16, 16' or 16" and the associated reference surface 26, 26' or 26" relative to the center 32 of the electromagnetic lens 12. For example, with the dielectric substrate 16 substantially aligned with the center 32, the directions 42 of the one or more beams of electromagnetic energy 20 are nominally aligned with the reference surface 26. Alternately, with the dielectric substrate 16' above the center 32 of the electromagnetic lens 12, 12', the resulting one or more beams of electromagnetic energy 20' propagate in directions 42' below the center 32. Similarly, with the dielectric substrate 16" below the center 32 of the electromagnetic lens 12, 12', the resulting one or more beams of electromagnetic energy 20" propagate in directions 42" above the center 32.

The multi-beam antenna 10 may further comprise at least one transmission line 44 on the dielectric substrate 16 operatively connected to a feed port 46 of one of the plurality of antenna feed elements 14 for feeding a signal to the associated antenna feed element 14. For example, the at least one transmission line 44 may comprise either a stripline, a microstrip line, an inverted microstrip line, a slotline, an image line, an insulated image line, a tapped image line, a coplanar stripline, or a coplanar waveguide line formed on the dielectric substrate 16, for example, from a printed circuit board 34.1, for example, by subtractive technology, for example, chemical or ion etching, or stamping; or additive techniques, for example, deposition, bonding or lamination.

The multi-beam antenna 10 may further comprise a switching network 48 having at least one input 50 and a plurality of outputs 52, wherein the at least one input 50 is operatively connected—for example, via at least one above described transmission line 44—to a corporate antenna feed port 54, and each output 52 of the plurality of outputs 52 is connected—for example, via at least one above described transmission line 44—to a respective feed port 46 of a different antenna feed element 14 of the plurality of antenna feed elements 14. The switching network 48 further comprises at least one control port 56 for controlling which outputs 52 are connected to the at least one input 50 at a given time. The switching network 48 may, for example, comprise either a plurality of micro-mechanical switches, PIN diode switches, transistor switches, or a combination thereof, and may, for example, be operatively connected to the dielectric substrate 16, for example, by surface mount to an associated conductive layer 36 of a printed circuit board 34.1.

In operation, a feed signal 58 applied to the corporate antenna feed port 54 is either blocked—for example, by an open circuit, by reflection or by absorption,—or switched to the associated feed port 46 of one or more antenna feed elements 14, via one or more associated transmission lines 44, by the switching network 48, responsive to a control signal 60 applied to the control port 56. It should be understood that the feed signal 58 may either comprise a single signal common to each antenna feed element 14, or a plurality of signals associated with different antenna feed elements 14. Each antenna feed element 14 to which the feed signal 58 is applied launches an associated electromagnetic wave into the first side 22 of the associated electromagnetic lens 12, which is diffracted thereby to form an associated beam of electromagnetic energy 20. The associated beams of electromagnetic energy 20 launched by different antenna feed elements 14 propagate in different associated directions 42. The various beams of electromagnetic energy 20 may be generated individually at different times so as to provided for a scanned beam of electromagnetic energy 20. Alternately, two or more beams of electromagnetic energy 20 may be generated simultaneously. Moreover, different antenna feed elements 14 may be driven by different frequencies that, for example, are either directly switched to the respective antenna feed elements 14, or switched via an associated switching network 48 having a plurality of inputs 50, at least some of which are each connected to different feed signals 58.

Figure 5:
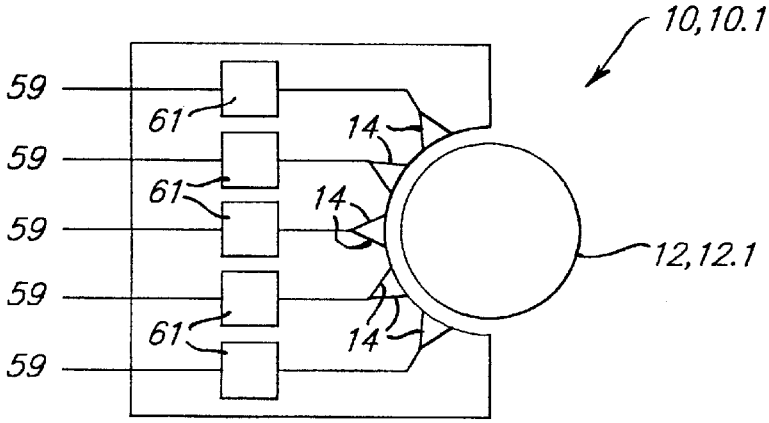
FIG. 5 illustrates an embodiment wherein each antenna feed element is operatively coupled to a separate signal.

Referring to FIG. 5, the multi-beam antenna 10, 10.1 may be adapted so that the respective signals are associated with the respective antenna feed elements 14 in a one-to-one relationship, thereby precluding the need for an associated switching network 48. For example, each antenna feed element 14 can be operatively connected to an associated signal 59 through an associated processing element 61. As one example, with the multi-beam antenna 10, 10.1 configured as an imaging array, the respective antenna feed elements 14 are used to receive electromagnetic energy, and the respective processing elements 61 comprise detectors. As another example, with the multi-beam antenna 10, 10.1 configured as a communication antenna, the respective antenna feed elements 14 are used to both transmit and receive electromagnetic energy, and the respective processing elements 61 comprise transmit/receive modules or transceivers.

Figure 6:
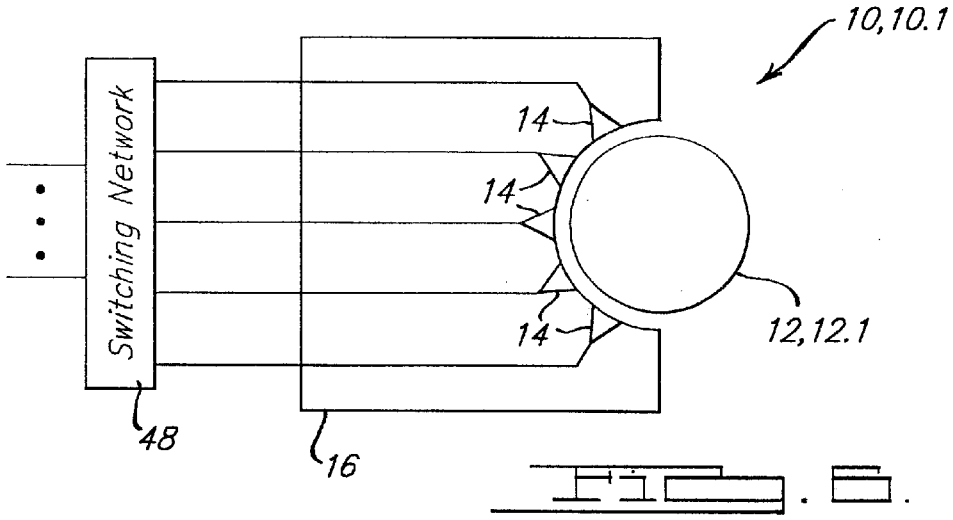
FIG. 6 illustrates an embodiment wherein the switching network is separately located from the dielectric substrate.

Referring to FIG. 6, the switching network 48, if used, need not be collocated on a common dielectric substrate 16, but can be separately located, as, for example, may be useful for low frequency applications, for example, 1–20 GHz.

Figure 7:
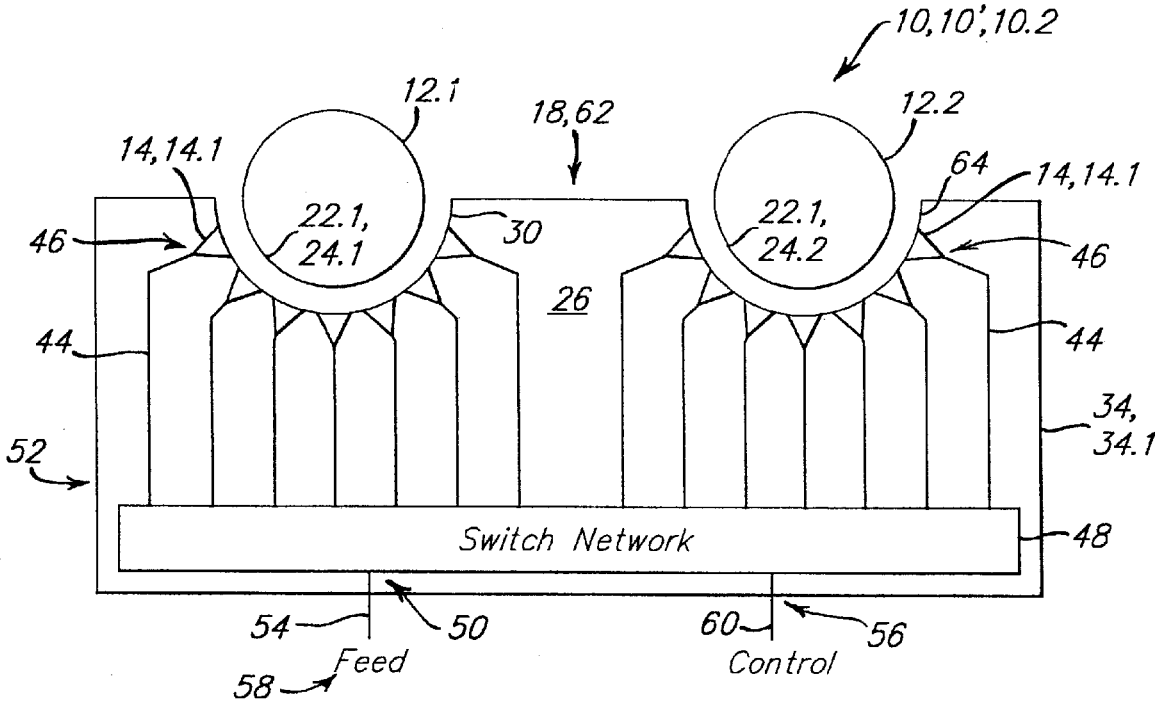
FIG. 7 illustrates a top view of a second embodiment of a multi-beam antenna, comprising a plurality electromagnetic lenses located proximate to one edge of a dielectric substrate.
Figure 8:
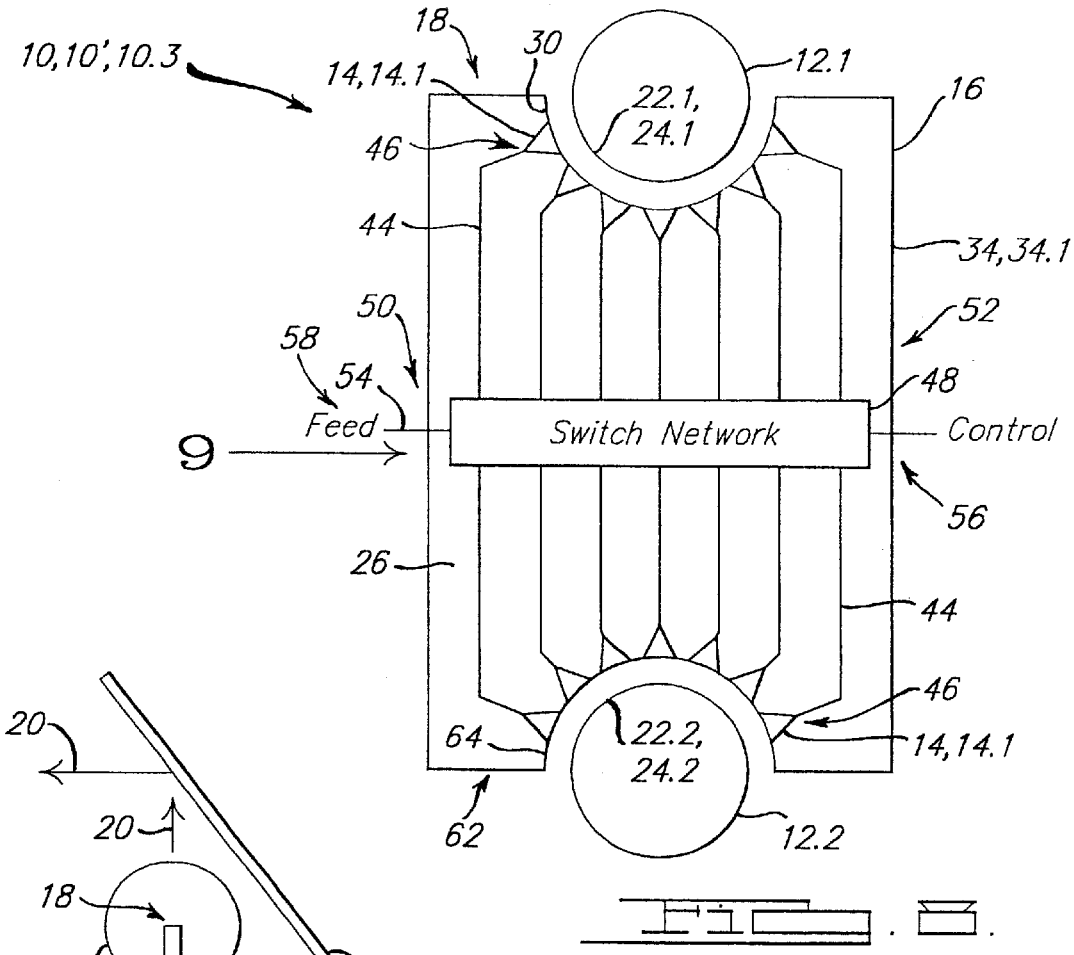
FIG. 8 illustrates a top view of a third embodiment of a multi-beam antenna, comprising a plurality electromagnetic lenses located proximate to opposite edges of a dielectric substrate.
Figure 9:
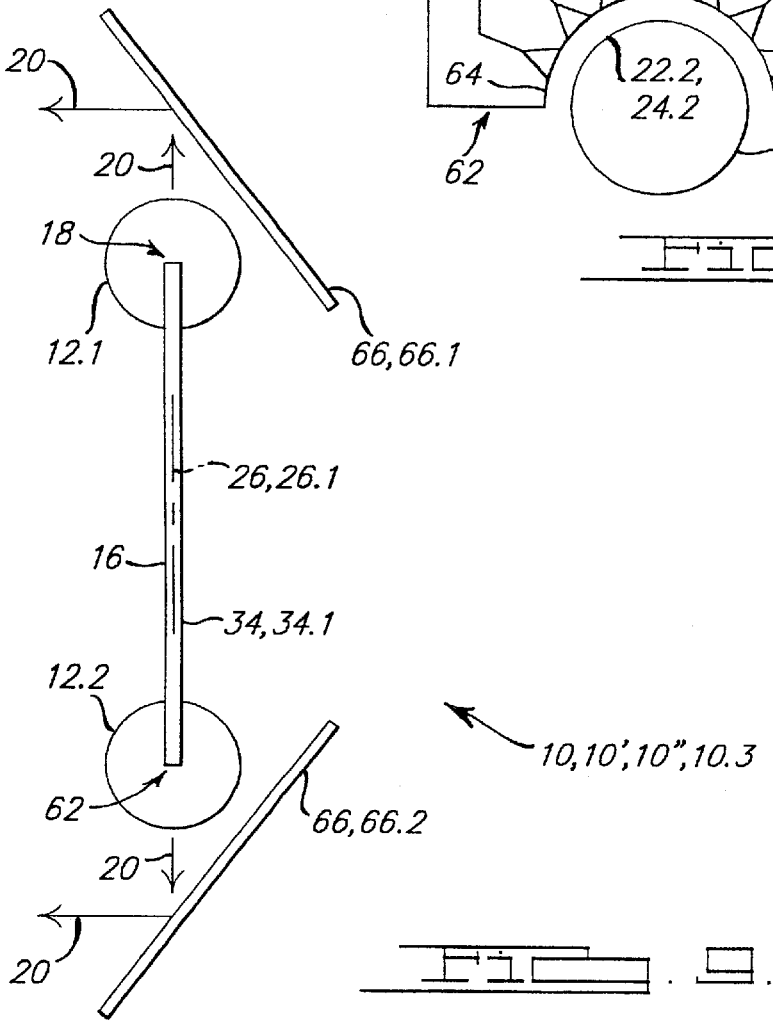
FIG. 9 illustrates a side view of the third embodiment illustrated in FIG. 8, further comprising a plurality of reflectors.

Referring to FIGS. 7, 8 and 9, in accordance with a second aspect, a multi-beam antenna 10' comprises at least a first 12.1 and a second 12.2 electromagnetic lens, each having a first side 22.1, 22.2 with a corresponding first contour 24.1, 24.2 at an intersection of the respective first side 22.1, 22.2 with the reference surface 26. The dielectric substrate 16 comprises at least a second edge 62 comprising a third contour 64, wherein the second contour 30 is proximate to the first contour 24.1 of the first electromagnetic lens 12.1 and the third contour 64 is proximate to the first contour 24.2 of the second electromagnetic lens 12.2.

Referring to FIG. 7, in accordance with a second embodiment of the multi-beam antenna 10.2, the second edge 62 is the same as the first edge 18 and the second 30 and third 64 contours are displaced from one another along the first edge 18 of the dielectric substrate 16.

Referring to FIG. 8, in accordance with a third embodiment of the multi-beam antenna 10.3, the second edge 62 is different from the first edge 18, and more particularly is opposite to the first edge 18 of the dielectric substrate 16.

Referring to FIG. 9, in accordance with a third aspect, a multi-beam antenna 10" comprises at least one reflector 66, wherein the reference surface 26 intersects the at least one reflector 66 and one of the at least one electromagnetic lens 12 is located between the dielectric substrate 16 and the reflector 66. The at least one reflector 66 is adapted to reflect electromagnetic energy propagated through the at least one electromagnetic lens 12 after being generated by at least one of the plurality of antenna feed elements 14. A third embodiment of the multi-beam antenna 10 comprises at least first 66.1 and second 66.2 reflectors wherein the first electromagnetic lens 12.1 is located between the dielectric substrate 16 and the first reflector 66.1, the second electromagnetic lens 12.2 is located between the dielectric substrate 16 and the second reflector 66.2, the first reflector 66.1 is adapted to reflect electromagnetic energy propagated through the first electromagnetic lens 12.1 after being generated by at least one of the plurality of antenna feed elements 14 on the second contour 30, and the second reflector 66.2 is adapted to reflect electromagnetic energy propagated through the second electromagnetic lens 12.2 after being generated by at least one of the plurality of antenna feed elements 14 on the third contour 64. For example, the first 66.1 and second 66.2 reflectors may be oriented to direct the beams of electromagnetic energy 20 from each side in a common nominal direction, as illustrated in FIG. 9. Referring to FIG. 9, the multi-beam antenna 10" as illustrated would provide for scanning in a direction normal to the plane of the illustration. If the dielectric substrate 16 were rotated by 90 degrees with respect to the reflectors 66.1, 66.2, about an axis connecting the respective electromagnetic lenses 12.1, 12.1, then the multi-beam antenna 10" would provide for scanning in a direction parallel to the plane of the illustration.

Figure 10:
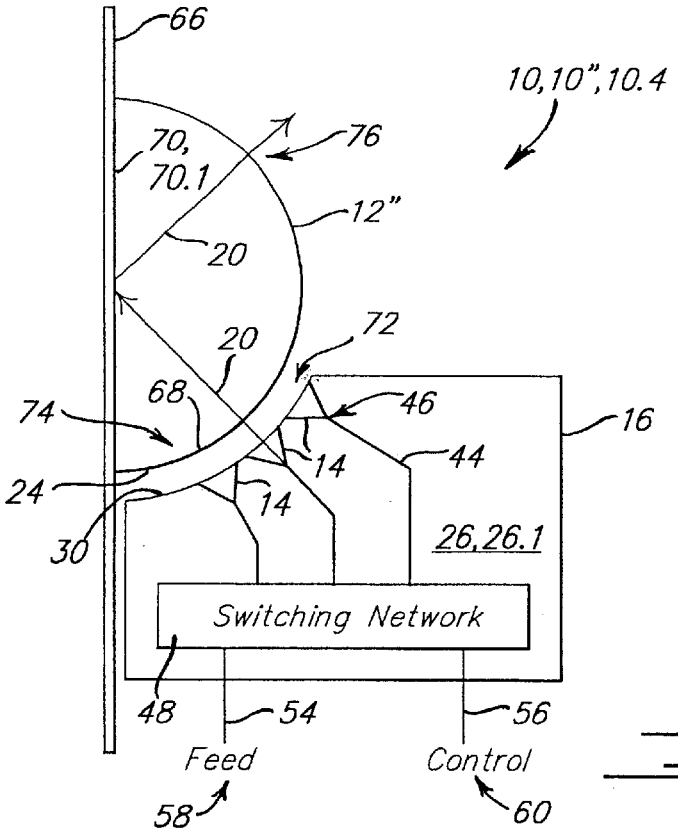
FIG. 10 illustrates a fourth embodiment of a multi-beam antenna, comprising an electromagnetic lens and a reflector.

Referring to FIG. 10, in accordance with the third aspect and a fourth embodiment, a multi-beam antenna 10", 10.4 comprises an at least partially spherical electromagnetic lens 12'", for example, a hemispherical electromagnetic lens, having a curved surface 68 and a boundary 70, for example a flat boundary 70.1. The multi-beam antenna 10", 10.4 further comprises a reflector 66 proximate to the boundary 70, and a plurality of antenna feed elements 14 on a dielectric substrate 16 proximate to a contoured edge 72 thereof, wherein each of the antenna feed elements 14 is adapted to radiate a respective plurality of beams of electromagnetic energy 20 into a first sector 74 of the electromagnetic lens 12'". The electromagnetic lens 12'" has a first contour 24 at an intersection of the first sector 74 with a reference surface 26, for example, a plane 26.1. The contoured edge 72 has a second contour 30 located on the reference surface 26 that is proximate to the first contour 24 of the first sector 74. The multi-beam antenna 10", 10.4 further comprises a switching network 48 and a plurality of transmission lines 44 operatively connected to the antenna feed elements 14 as described hereinabove for the other embodiments.

In operation, at least one feed signal 58 applied to a corporate antenna feed port 54 is either blocked, or switched to the associated feed port 46 of one or more antenna feed elements 14, via one or more associated transmission lines 44, by the switching network 48 responsive to a control signal 60 applied to a control port 56 of the switching network 48. Each antenna feed element 14 to which the feed signal 58 is applied launches an associated electromagnetic wave into the first sector 74 of the associated electromagnetic lens 12'". The electromagnetic wave propagates through—and is diffracted by—the curved surface 68, and is then reflected by the reflector 66 proximate to the boundary 70, whereafter the reflected electromagnetic wave propagates through the electromagnetic lens 12'" and exits—and is diffracted by—a second sector 76 as an associated beam of electromagnetic energy 20. With the reflector 66 substantially normal to the reference surface 26—as illustrated in FIG. 10—the different beams of electromagnetic energy 20 are directed by the associated antenna feed elements 14 in different directions that are nominally substantially parallel to the reference surface 26.

Figure 11:
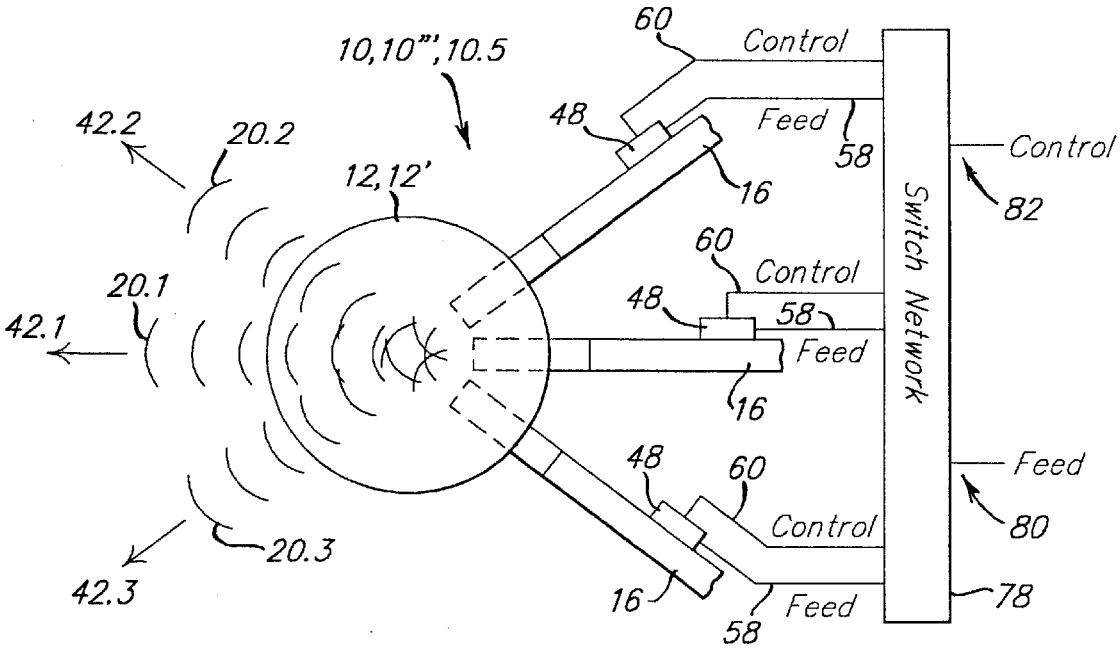
FIG. 11 illustrates a fifth embodiment of a multi-beam antenna.

Referring to FIG. 11, in accordance with a fourth aspect and a fifth embodiment, a multi-beam antenna 10'", 10.5 comprises an electromagnetic lens 12 and plurality of dielectric substrates 16, each comprising a set of antenna feed elements 14 and operating in accordance with the description hereinabove. Each set of antenna feed elements 14 generates (or is capable of generating) an associated set of beams of electromagnetic energy 20.1, 20.2 and 20.3, each having associated directions 42.1, 42.2 and 42.3, responsive to the associated feed 58 and control 60 signals. The associated feed 58 and control 60 signals are either directly applied to the associated switch network 48 of the respective sets of antenna feed elements 14, or are applied thereto through a second switch network 78 have associated feed 80 and control 82 ports, each comprising at least one associated signal. Accordingly, the multi-beam antenna 10'", 10.4 provides for transmitting or receiving one or more beams of electromagnetic energy over a three-dimensional space.

The multi-beam antenna 10 provides for a relatively wide field-of-view, and is suitable for a variety of applications, including but not limited to automotive radar, point-to-point communications systems and point-to-multi-point communication systems, over a wide range of frequencies for which the antenna feed elements 14 may be designed to radiate, for example, 1 to 200 GHz. Moreover, the multi-beam antenna 10 may be configured for either mono-static or bi-static operation.

Figure 12:
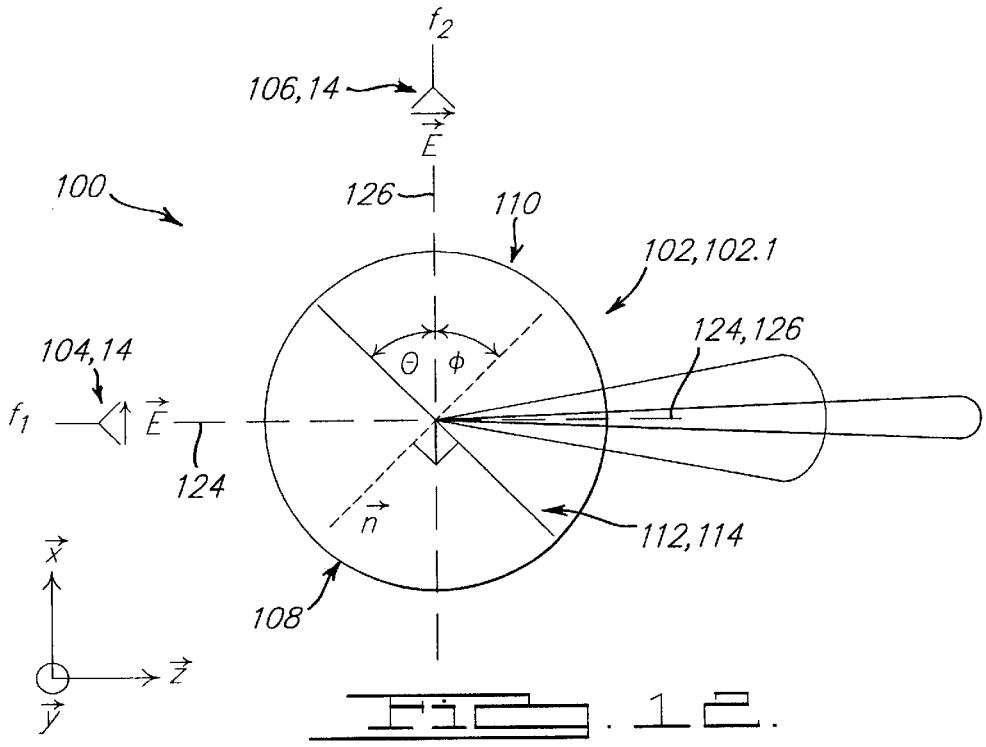
FIG. 12 illustrates a sixth embodiment of a multi-beam antenna incorporating a first embodiment of a selective element.

Referring to FIG. 12, in accordance with a fifth aspect and a sixth embodiment, a multi-beam antenna 100 comprises an electromagnetic lens 102, at least one first antenna feed element 104, 14, and at least one second antenna feed element 106, 14. The electromagnetic lens 102 comprises first 108 and second 110 portions, wherein the at least one first antenna feed element 104, 14 is located proximate to the first portion 108 of the electromagnetic lens 102, and the at least one second antenna feed element 106, 14 is located proximate to the second portion 110 of the electromagnetic lens 102, so that the respective feed elements 104 106, 14 cooperate with the respective portions 108, 110 of the electromagnetic lens 102 to which they are proximate. For example, the electromagnetic lens 102 may comprise either a spherical lens 102.1, a Luneburg lens, a spherical shell lens, a hemispherical lens, an at least partially spherical lens, an at least partially spherical shell lens, a cylindrical lens, or a rotational lens—divided into first 108 and second 110 portions.

The multi-beam antenna 100 further comprises a selective element 112 located between the first 108 and second 110 portions of the electromagnetic lens 102, wherein the selective element 112 has a transmissivity and a reflectivity that are responsive to an electromagnetic wave property, for example either frequency or polarization. The transmissivity of the selective element 112 is adapted so that a first electromagnetic wave, in cooperation with the first antenna feed element 104, 14 and having a first value of the electromagnetic wave property, is substantially transmitted through the selective element 112 so as to propagate in both the first 108 and second 110 portions of the electromagnetic lens 102. The reflectivity of the selective element 112 is adapted so that a second electromagnetic wave, in cooperation with the second antenna feed element 106, 14 and having a second value of the electromagnetic wave property, is substantially reflected by the selective element 112. In the sixth embodiment illustrated in FIG. 12, the selective element 112 is adapted with a frequency selective surface 114—essentially a diplexer—so that the transmissivity and reflectivity thereof are responsive to the frequency of an electromagnetic wave impinging thereon. Accordingly, a first electromagnetic wave having a first carrier frequency $f_1$ and cooperating with the first antenna feed element 104, 14 is transmitted, with relatively little attenuation, through the selective element 112, and a second electromagnetic wave having a second carrier frequency $f_2$—different from the first carrier frequency $f_1$—and cooperating with the second antenna feed element 106, 14 is reflected, with relatively little attenuation, by the selective element 112.

Figure 13:
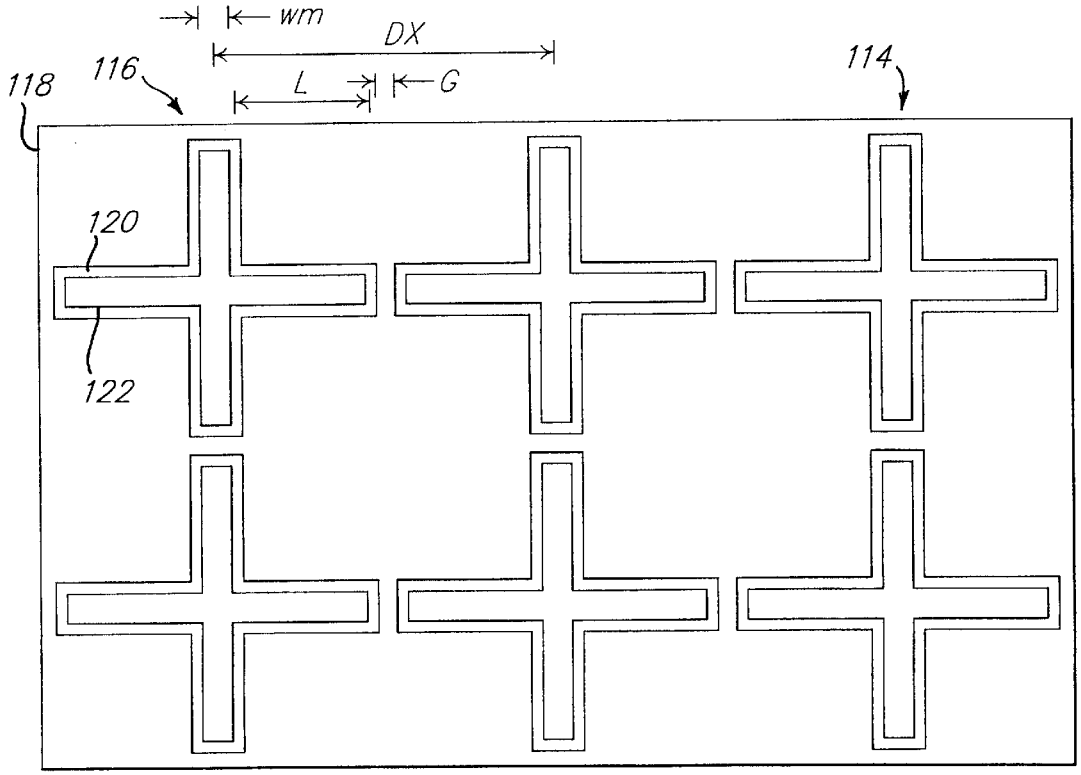
FIG. 13 illustrates an example of a frequency selective surface in accordance with the first embodiment of the selective element.
Figure 14:
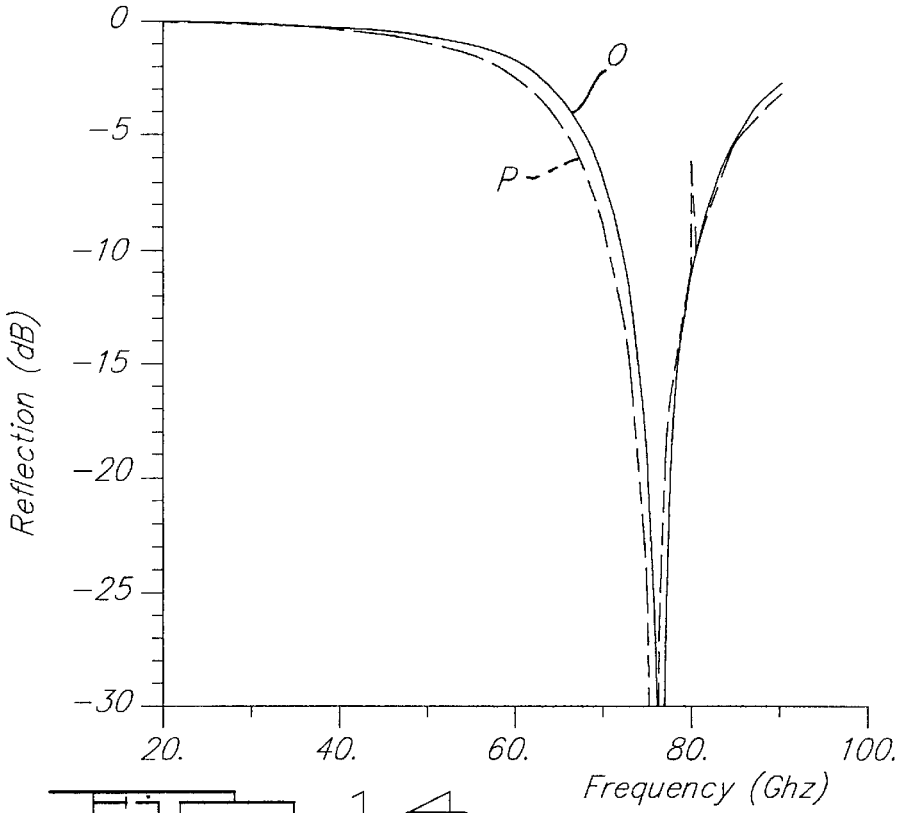
FIG. 14 illustrates the reflectivity as a function of frequency of the frequency selective surface illustrated in FIG. 13.
Figure 15:
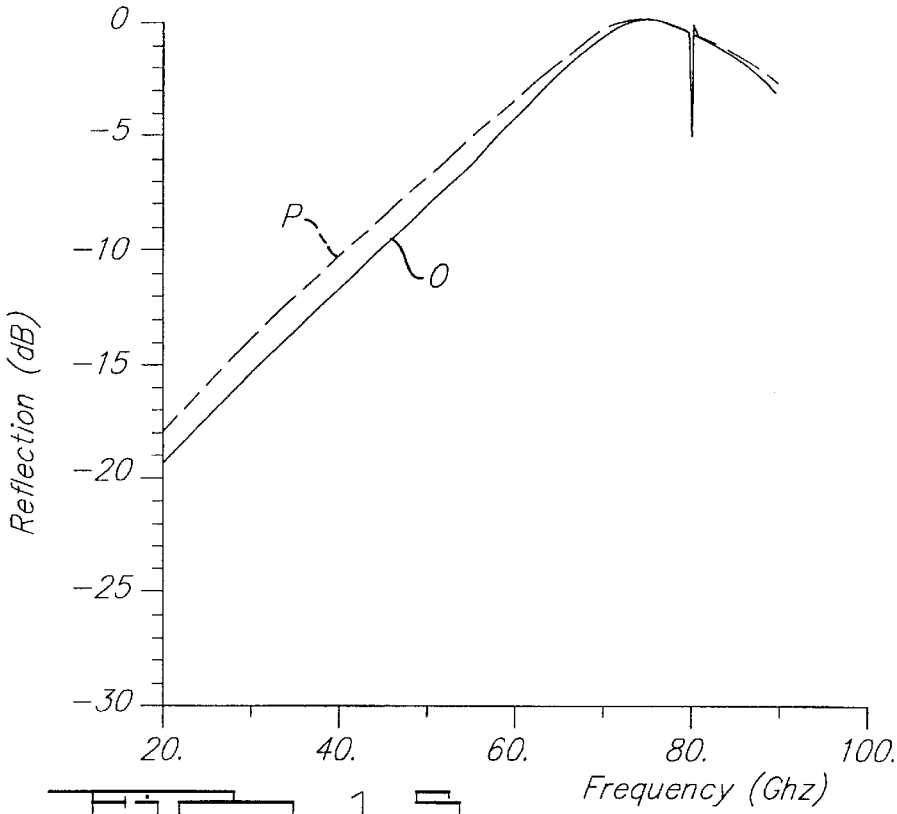
FIG. 15 illustrates the transmissivity as a function of frequency of the frequency selective surface illustrated in FIG. 13.

The frequency selective surface 114 can be constructed by forming a periodic structure of conductive elements, e.g. by etching a conductive sheet on a substrate material having a relatively low dielectric constant, e.g. DUROID™ or TEFLON™. For example, referring to FIG. 13, the frequency selective surface 114 is formed by a field of what are known as Jerusalem Crosses 116, which provides for reflectivity and transmissivity characteristics illustrated in FIGS. 14 and 15 respectively, wherein the frequency selective surface 114 is sized so as to substantially transmit a first electromagnetic wave having an associated first carrier frequency $f_1$ of 77 GHz, and to substantially reflect a second electromagnetic wave having an associated first carrier frequency $f_1$ of 24 GHz. In FIGS. 14 and 15, "O" and "P" represent orthogonal and parallel polarizations respectively. Each Jerusalem Cross 116 is separated from a surrounding conductive surface 118 by a slot 120 that is etched thereinto, wherein the slot 120 has an associated slot width ws. Each Jerusalem Cross 116 comprises four legs 122 of leg length L and leg width wm extending from a central square hub and forming a cross. Adjacent Jerusalem Crosses 116 are separated from one another by the associated slots 120, and by conductive gaps G, so as to form a periodic structure with a periodicity DX in both associated directions of the Jerusalem Crosses 116. The exemplary embodiment illustrated in FIG. 13 having a pass frequency of 77 GHz is characterized as follows: slot width ws=80 microns, leg width wm=200 microns, gap G=150 microns, leg length L=500 microns, and periodicity DX=1510 microns (in both orthogonal directions), where DX=wm+2(L+ws)+G. Generally the frequency selective surface 114 comprises a periodic structure of conductive elements, for example, located on a dielectric substrate, for example, substantially located on a plane. The conductive elements need not necessarily be located on a substrate. For example, the frequency selective surface 114 could be constructed from a conductive material with periodic holes or openings of appropriate size, shape and spacing. Alternately, the frequency selective surface 114 may comprise a conductive layer on one or both inner surfaces of the respective first 108 and second 110 portions of the electromagnetic lens 102. Whereas FIG. 13 illustrates a Jerusalem Cross 116 as a kernel element of the associate periodic structure of the frequency selective surface 114, other shapes for the kernel element are also possible, for example circular, doughnut, rectangular, square, or potent cross, for example, as illustrated in the following technical papers that are incorporated herein by reference: "Antenna Design on Periodic and Aperiodic Structures" by Zhifang Li, John L. Volakis and Panos Y. Papalambros accessible at Internet address http://ode.engin.umich.edu/papers/APS2000.pdf; and "Plane Wave Diffraction by Two-Dimensional Gratings of Inductive and Capacitive Coupling Elements" by Yu. N. Kazantsev, V. P. Mal'tsev, E. S. Sokolovskaya, and A. D. Shatrov in "Journal of Radioelectronics" N. 9, 2000 accessible at Internet address http://jre.cplire.ru/jre/sep00/4/text.html.

Experiments have also shown that in a system with first $f_1$ and second $f_2$ carrier frequencies selected from 24 GHz and 77 GHz, an electromagnetic wave having a 24 GHz carrier frequency generates harmonic modes when passed through the frequency selective surface 114 illustrated in FIG. 13. Accordingly, the first carrier frequency $f_1$ (of the transmitted electromagnetic wave) greater than the second carrier frequency $f_2$ (of the reflected electromagnetic wave) would beneficially provide for reduced harmonic modes. However, it is possible to have a wider field of view in the transmitted electromagnetic wave than in the reflected electromagnetic wave. More particularly, the beam patterns from a reflected feed source are, for example, only well behaved over a range of approximately ±20°, which would limit the field of view to approximately 40°. In some applications, e.g. automotive radar, it is beneficial for the lower frequency electromagnetic wave to have a wider field of view. Accordingly, it can be beneficial for the first carrier frequency $f_1$ (of the transmitted electromagnetic wave) to have the lower frequency (e.g. 24 GHz), which can be facilitated with a multiple layer frequency selective surface 114.

The frequency selective surface 114 may comprise either a single layer or a multiple layer. A multiple layer frequency selective surface 114 may provide for controlling the harmonic modes, for example, as generated by the lower frequency radiation, thereby improving the transmission of the lower frequency radiation through the frequency selective surface 114, so as to provide for a wider field of view of the associated radiation pattern extending from the electromagnetic lens 102.

The at least one first antenna feed element 104, 14 and at least one second antenna feed element 106, 14 comprises respective end-fire antenna elements adapted to launch electromagnetic waves in a direction substantially towards the first 108 and second 110 portions of the at least one electromagnetic lens 102 respectively. For example, each of the respective end-fire antenna elements may be either a Yagi-Uda antenna, a coplanar horn antenna, a Vivaldi antenna, a tapered dielectric rod, a slot antenna, a dipole antenna, or a helical antenna.

The at least one first antenna feed element 104, 14 has a corresponding at least one first axis of principal gain 124, which is directed through both the first 108 and second 110 portions of the electromagnetic lens 102, and the at least one second antenna feed element 106, 14 has a corresponding at least one second axis of principal gain 126, which is directed through at least the second portion 110 of the electromagnetic lens 102, and the at least one second antenna feed element 106, 14 and the selective element 112 are adapted so that a reflection at least one second axis of principal gain 126 from the selective element 112 is generally aligned with at least one first axis of principal gain 124 in the second portion 110 of the electromagnetic lens 102.

Figure 16B:
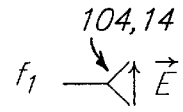
FIGS. 16*a* and 16*b* illustrate a seventh embodiment of a multi-beam antenna incorporating a second embodiment of the selective element.
Figure 16A:
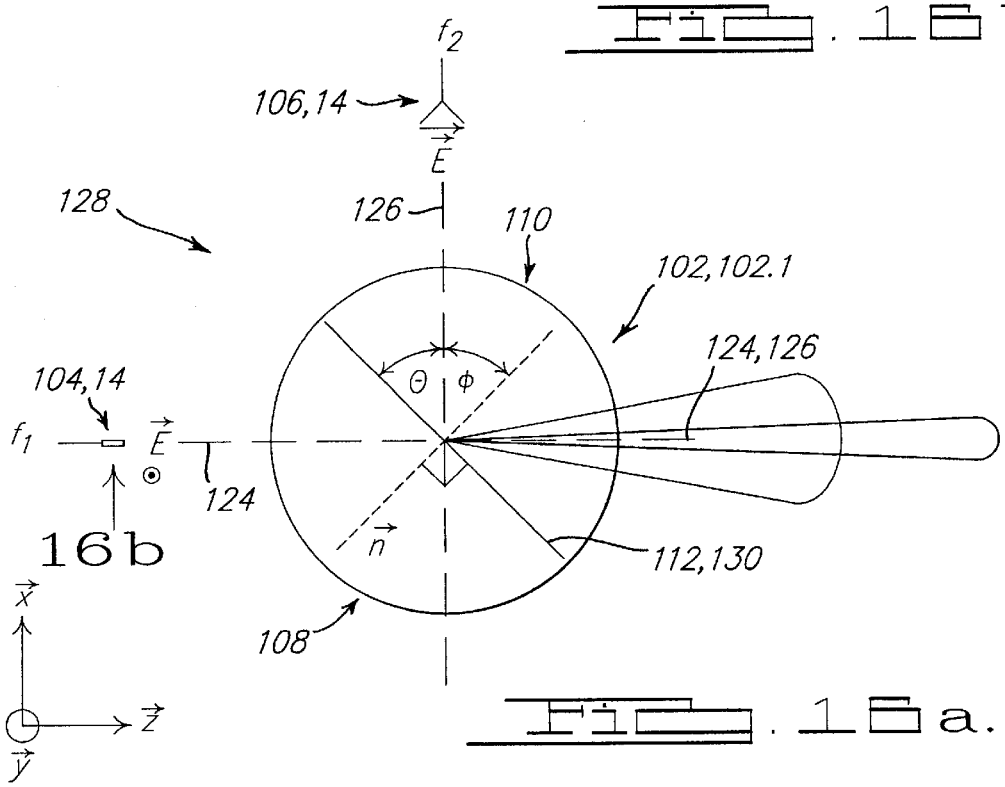

Referring to FIG. 16*a*, in accordance with a seventh embodiment, a multi-beam antenna 128 incorporates a polarization selective element 130 for which the reflectivity or transmissivity thereof is responsive to the polarization of the electromagnetic wave impinging thereon. More particularly, one of two orthogonal polarizations is substantially transmitted by the polarization selective element 130, and the other of two orthogonal polarizations is substantially reflected by the polarization selective element 130. For example, the first electromagnetic wave associated with the first antenna feed element 104, 14 is polarized in the y direction—e.g. by rotating the first antenna feed element 104, 14 relative to the second antenna feed element 106, 14, or by an associated antenna feed element that is orthogonally polarized with respect to the associated underlying substrate—so as to be substantially transmitted (i.e. with relatively small attenuation) through the polarization selective element 130; and the second electromagnetic wave associated with the second antenna feed element 106, 14 is polarized in the z direction so as to be substantially reflected by the polarization selective element 130. For example, the polarization selective element 130 can be what is known as a polarized reflector, wherein the second antenna feed element 106, 14 is adapted to have the same polarization as the polarized reflector. For example, a polarized reflective surface can be fabricated by etching properly dimensioned parallel metal lines at an associated proper spacing on a relatively low dielectric substrate.

Figure 17:
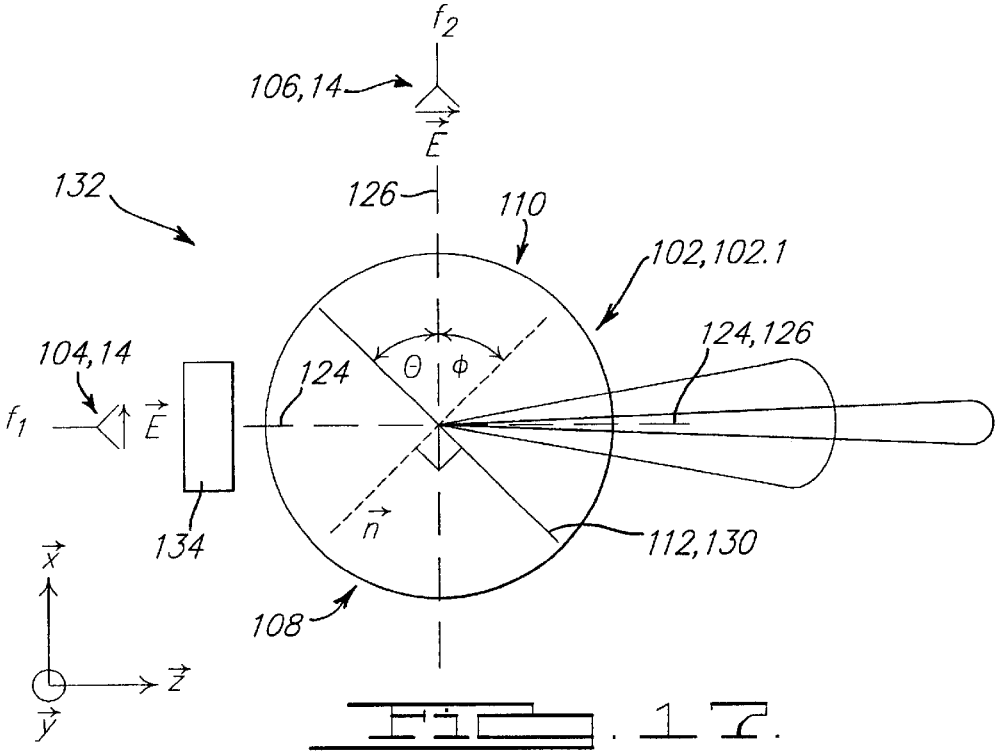
FIG. 17 illustrates an eighth embodiment of a multi-beam antenna incorporating the second embodiment of the selective element, further incorporating a polarization rotator.

Referring to FIG. 17, in accordance with an eighth embodiment of a multi-beam antenna 132 incorporating a polarization selective element 130, a polarization rotator 134 is incorporated between the first antenna feed element 104, 14 and the electromagnetic lens 102 of the electromagnetic lens 102, for example, so that the first 104 and second 106 antenna feed elements 14 can be constructed on a common substrate. Alternately, instead of incorporating a separate polarization rotator 134, the first portion 108 of the electromagnetic lens 102 may be adapted to incorporated an associated polarization rotator.

It should be understood that the polarization selective element 130 and associated second antenna feed element 106, 14, or polarization rotator 134 proximate thereto, may alternately be adapted as was the first antenna feed element 104, 14, or polarization rotator 134 proximate thereto, in the embodiments of FIGS. 16*a* and 17. The resulting beam patterns for a polarization selective element 130 would be similar to those for a frequency selective surface 114.

Figure 18:
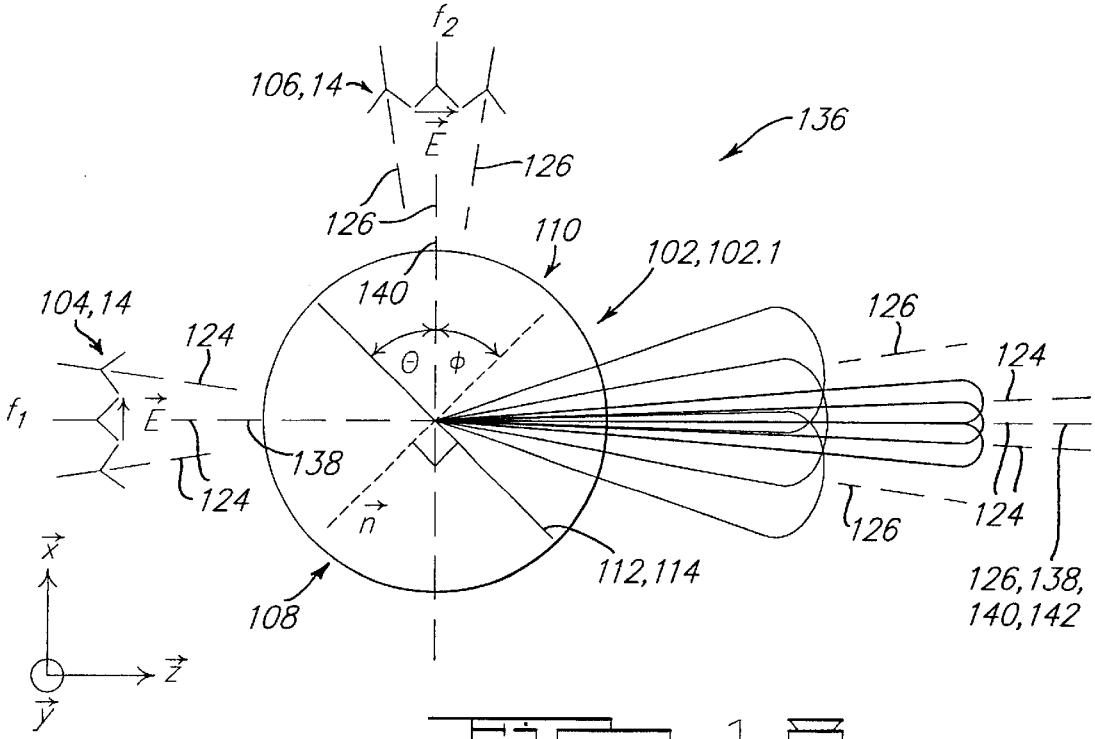
FIG. 18 illustrates a ninth embodiment of a multi-beam antenna incorporating the first embodiment of the selective element.

Referring to FIG. 18, in accordance with a ninth embodiment, a multi-beam antenna 136 incorporates a plurality of first antenna feed elements 104, 14 and a plurality of second antenna feed elements 106, 14 so as to provide for multi-beam coverage by each. The plurality of first antenna feed elements 104, 14 has an associated first median axis of principal gain 138, and the plurality of second antenna feed elements 106, 14 has an associated second median axis of principal gain 140.

For example, by orienting the frequency selective surface 114 at an angle $\theta=45°$ to the intended median direction of propagation, and the plurality of second antenna feed elements 106, 14 at an angle $\theta+\phi=90°$, the associated second electromagnetic wave(s) can be propagated in the intended direction. By orienting the plurality of first antenna feed elements 104, 14 on the median axis of intended propagation, the associated first electromagnetic wave(s) will propagate through the selective element 112 along the intended direction of propagation. The particular angle $\theta$ is not considered to be limiting. Moreover, a polarization selective element 130 can generally operate over a relatively wide range of angles.

The pluralities of first 104 and second 106 antenna feed elements 106, 14 may be constructed as described hereinabove for the embodiments illustrated in FIGS. 1–5, wherein the direction for at least one the first end-fire antenna elements is different for the direction of at least another the first end-fire antenna element, and the direction for at least one the second end-fire antenna element is different for the direction of at least another the second end-fire antenna element.

For example, the at least one first antenna feed element 104, 14 comprises a plurality of first antenna feed elements 104, 14 arranged substantially on a first plane, and the at least one second antenna feed element 106, 14 comprises a plurality of second antenna feed elements 106, 14 arranged substantially on a second plane. The first and second planes are at least substantially parallel to one another in one embodiment, and may be at least substantially coplanar so as to provide for mounting all of the antenna feed elements 104, 106, 14 on a common substrate.

The at least one first antenna feed element 104, 14 has a corresponding first median axis of principal gain 138, which is directed through both the first 108 and second 110 portion 110 of the electromagnetic lens 102. The at least one second antenna feed element 106, 14 has a corresponding second median axis of principal gain 140, which is directed through at least the second portion 110 of the electromagnetic lens 102, and the at least one second antenna feed element 106, 14 and the selective element 112 are adapted so that a reflection 142 of the second median axis of principal gain 140 from the selective element 112 is generally aligned with the first median axis of principal gain 138 in the second portion 110 of the electromagnetic lens 102.

Figure 19:
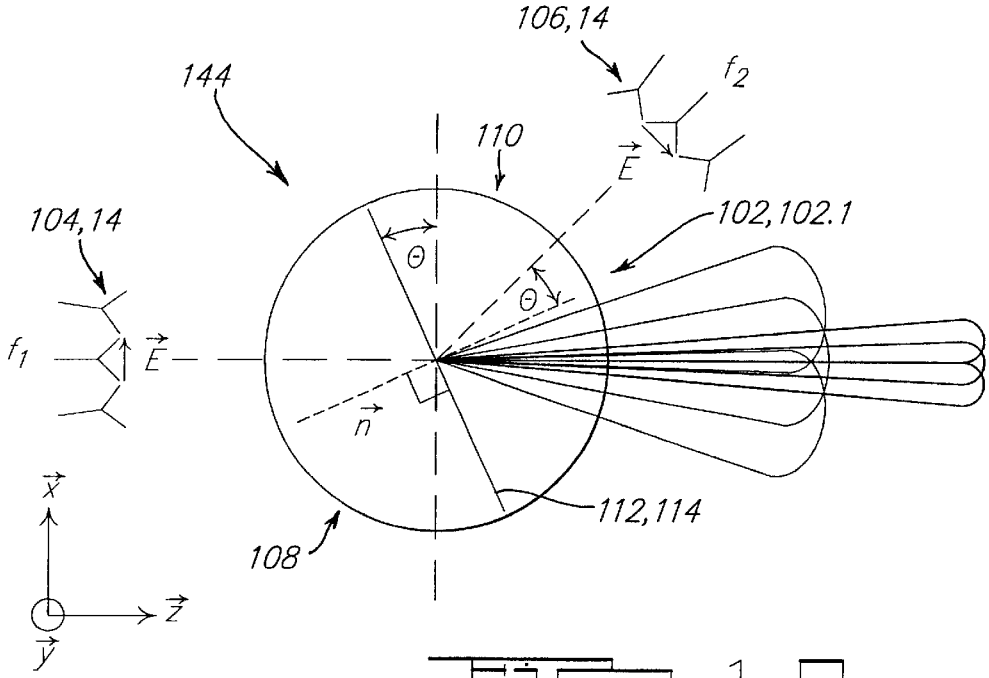
FIG. 19 illustrates a tenth embodiment of a multi-beam antenna incorporating the first embodiment of the selective element.
Figure 20A:
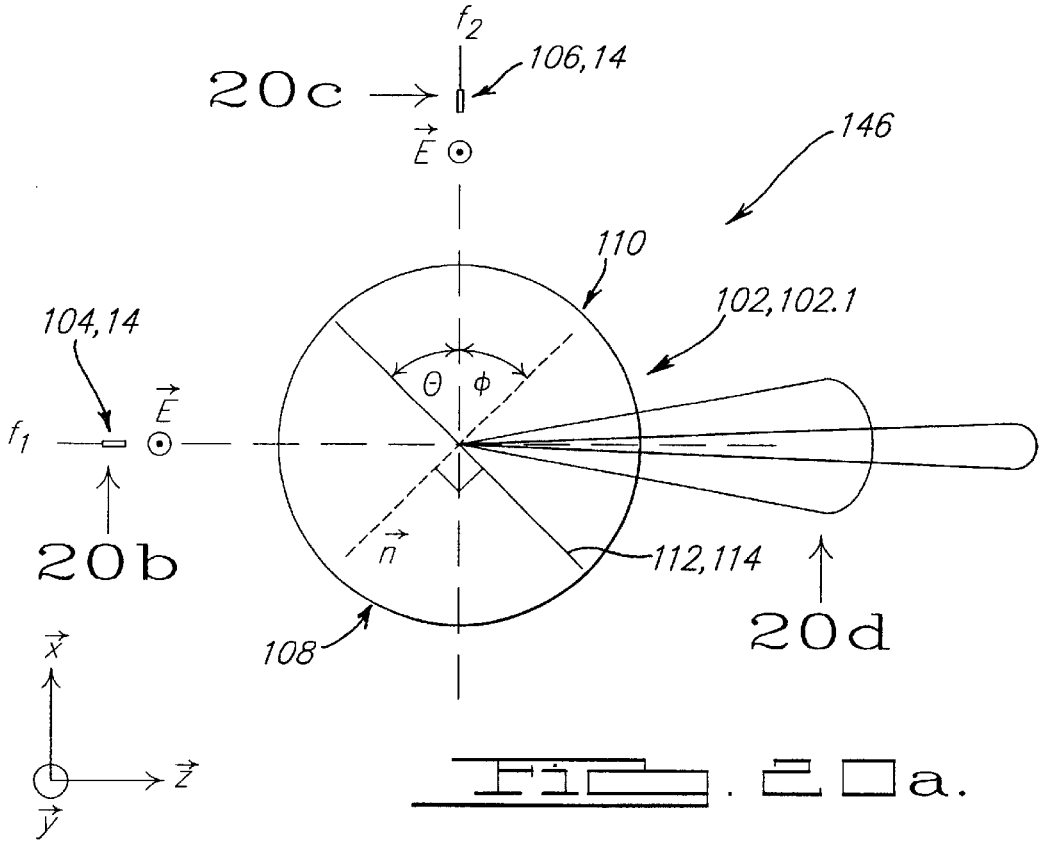
FIGS. 20*a*, 20*b*, 20*c* and 20*d* illustrates an eleventh embodiment of a multi-beam antenna incorporating the first embodiment of the selective element.
Figure 20B:
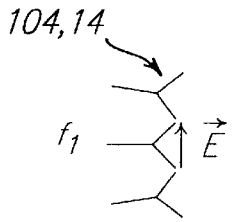
Figure 20C:
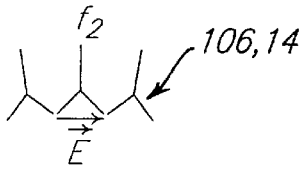
Figure 20D:
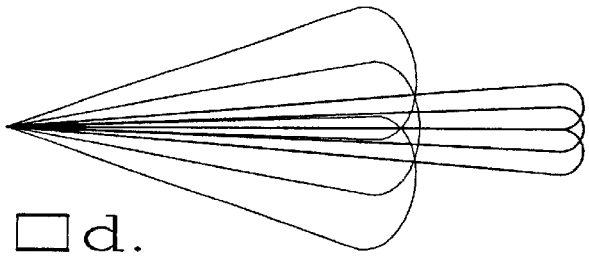

Referring to FIG. 19, in accordance with a tenth embodiment, a multi-beam antenna 144 is adapted for improved performance, resulting in an offset angle of about 25 degrees for the frequency selective surface 114 illustrated in FIG. 13, for a first carrier frequency $f_1$ of 77 GHz, and a second carrier frequency $f_2$ of 24 GHz.

Referring to FIG. 20, in accordance with an eleventh embodiment, a multi-beam antenna 146 comprises a frequency selective surface 114 oriented orthogonal to that illustrated in FIG. 18, wherein the associated plurality of first antenna feed elements 104, 14 and the associated plurality of second antenna feed elements 106, 14 are each orthogonal to the respective orientations illustrated in FIG. 18. More particularly, the plurality of first antenna feed elements 104, 14 are oriented substantially in the y-z plane, and the plurality of second antenna feed elements 106, 14 are oriented substantially in the x-y plane, so that the plurality of first antenna feed elements 104, 14 and the plurality of second antenna feed elements 106, 14 are each substantially perpendicular to the x-z plane.

The multi-beam antenna 100 can be used to either transmit or receive electromagnetic waves. In operation, a first electromagnetic wave is transmitted or received along a first direction through an first portion 108 of an electromagnetic lens 102, and a second electromagnetic wave is transmitted or received through a second portion 110 of the electromagnetic lens 102. A substantial portion of the second electromagnetic wave is reflected from a selective element 112 in a region between the first 108 and second 110 portions of the electromagnetic lens 102. The operations of transmitting or receiving a second electromagnetic wave through a second portion 110 of the electromagnetic lens 102 and reflecting the second electromagnetic wave from the selective element 112 in a region between the first 108 and second portions 110 of the electromagnetic lens 102 are adapted so that both the first and second electromagnetic waves propagate along a similar median direction within the second portion 110 of the electromagnetic lens 102, and the selective element 112 transmits the first electromagnetic wave and reflects the second electromagnetic wave responsive to either a difference in carrier frequency or a difference in polarization of the first and second electromagnetic waves.

Accordingly, the multi-beam antenna 100, 128, 132, 136, 144 or 146 provides for using a common electromagnetic lens 102 to simultaneously focus electromagnetic waves having two different carrier frequencies $f_1$, $f_2$, thereby providing for different applications without requiring separate associated apertures, thereby providing for a more compact overall package size. One particular application of the multi-beam antenna 100, 128, 132, 136, 144 or 146 is for automotive radar for which 24 GHz radiation would be used for relatively near range, wide field of view, collision avoidance applications, as well as stop and go functionality and parking aid, and 77 GHz radiation would be used for long range autonomous cruise control applications. Using the same aperture provides for substantially higher gain and narrower beamwidths for the shorter wavelength 77 GHz radiation, hence allowing long range performance. The 24 GHz radiation would, on the other hand, present proportionally wider beamwidths and lower gain, suitable for wider field of view, shorter range applications.

While specific embodiments have been described in detail in the foregoing detailed description and illustrated in the accompanying drawings, those with ordinary skill in the art will appreciate that various modifications and alternatives to those details could be developed in light of the overall teachings of the disclosure. Accordingly, the particular arrangements disclosed are meant to be illustrative only and not limiting as to the scope of the invention, which is to be given the full breadth of the appended claims and any and all equivalents thereof.

We claim:

1. A multi-beam antenna, comprising:

a. an electromagnetic lens, wherein said electromagnetic lens comprises a first portion and a second portion;

b. at least one first antenna feed element, wherein said at least one first antenna feed element is adapted to cooperate with said first portion of said electromagnetic lens;

c. at least one second antenna feed element, wherein said at least one second antenna feed element is adapted to cooperate with said second portion of said electromagnetic lens; and d. a selective element located between said first and second portions of said electromagnetic lens, wherein said selective element has a transmissivity and a reflectivity, said transmissivity and said reflectivity are responsive to an electromagnetic wave property, the transmissivity of said selective element is adapted so that a first electromagnetic wave having a first value of said electromagnetic wave property is substantially transmitted through said selective element so as to propagate in both said first and second portions of said electromagnetic lens, the reflectivity of said selective element is adapted so that a second electromagnetic wave having a second value of said electromagnetic wave property is substantially reflected by said selective element, said first electromagnetic wave cooperates with said at least one first antenna feed element, and said second electromagnetic wave cooperates with said at least one second antenna feed element.

2. A multi-beam antenna as recited in claim 1, wherein said electromagnetic lens is selected from a spherical lens, a Luneburg lens, a spherical shell lens, a hemispherical lens, an at least partially spherical lens, an at least partially spherical shell lens, a cylindrical lens, and a rotational lens.

3. A multi-beam antenna as recited in claim 1, wherein said at least one first antenna feed element has a corresponding at least one first axis of principal gain, said at least one first axis of principal gain is directed through both said first and second portions of said electromagnetic lens, said at least one second antenna feed element has a corresponding at least one second axis of principal gain, said at least one second axis of principal gain is directed through at least said second portion of said electromagnetic lens, and said at least one second antenna feed element and said selective element are adapted so that a reflection of at least one of said at least one second axis of principal gain from said selective element is generally aligned with at least one said at least one first axis of principal gain in said second portion of said electromagnetic lens.

4. A multi-beam antenna as recited in claim 1, wherein said at least one first antenna feed element has a corresponding first median axis of principal gain, said first median axis of principal gain is directed through both said first and second portions of said electromagnetic lens, said at least one second antenna feed element has a corresponding second median axis of principal gain, said second median axis of principal gain is directed through at least said second portion of said electromagnetic lens, and said at least one second antenna feed element and said selective element are adapted so that a reflection of said second median axis of principal gain from said selective element is generally aligned with said first median axis of principal gain in said second portion of said electromagnetic lens.

5. A multi-beam antenna as recited in claim 1, wherein at least one first antenna feed element comprises a first end-fire antenna element adapted to launch electromagnetic waves in a direction substantially towards said first portion of said at least one electromagnetic lens, said direction for at least one said first end-fire antenna element is different for said direction of at least another said first end-fire antenna element, at least one second antenna feed element comprises a second end-fire antenna element adapted to launch electromagnetic waves in a direction substantially towards said second portion of said at least one electromagnetic lens, and said direction for at least one said second end-fire antenna element is different for said direction of at least another said second end-fire antenna element.

6. A multi-beam antenna as recited in claim 5, wherein said first and second end-fire antenna elements are selected from a Yagi-Uda antenna, a coplanar horn antenna, a Vivaldi antenna, a tapered dielectric rod, a slot antenna, a dipole antenna, and a helical antenna.

7. A multi-beam antenna as recited in claim 1, wherein said at least one first antenna feed element comprises a plurality of first antenna feed elements arranged substantially on a first plane, and said at least one second antenna feed element comprises a plurality of first antenna feed elements arranged substantially on a second plane.

8. A multi-beam antenna as recited in claim 7, wherein said first and second planes are at least substantially parallel to one another.

9. A multi-beam antenna as recited in claim 8, wherein said first and second planes are at least substantially coplanar.

10. A multi-beam antenna as recited in claim 1, wherein said selective element is substantially located on a third plane.

11. A multi-beam antenna as recited in claim 7, wherein said first plane, said second plane, and said selective element are each substantially perpendicular to a fourth plane.

12. A multi-beam antenna as recited in claim 1, wherein said electromagnetic wave property comprises frequency.

13. A multi-beam antenna as recited in claim 12, wherein said first electromagnetic wave comprises a first carrier frequency, said second electromagnetic wave comprises a second carrier frequency, and said second carrier frequency is different from said first carrier frequency.

14. A multi-beam antenna as recited in claim 12, wherein said selective element comprises a plurality of kernel elements, each said kernel element comprising either a conductor or an aperture in a conductor, each said kernel element having a shape selected from a Jerusalem Cross, a circular shape, a doughnut shape, a rectangular shape, a square shape, and a potent cross shape.

15. A multi-beam antenna as recited in claim 12, wherein said selective element comprises a plurality of at least partially conductive layers that are adapted to control harmonic modes.

16. A multi-beam antenna as recited in claim 12, wherein said selective element comprises a periodic structure of conductive elements.

17. A multi-beam antenna as recited in claim 16, wherein said periodic structure of conductive elements are located on a dielectric substrate.

18. A multi-beam antenna as recited in claim 16, wherein said conductive elements have a shape selected from a Jerusalem Cross, a circular shape, a doughnut shape, a rectangular shape, a square shape, and a potent cross shape.

19. A multi-beam antenna as recited in claim 1, wherein said electromagnetic wave property comprises polarization.

20. A multi-beam antenna as recited in claim 19, wherein said selective element comprises a polarized reflector.

21. A multi-beam antenna as recited in claim 20, wherein said at least one first antenna feed element is polarized in accordance with a first polarization, said at least one second antenna feed element is polarized in accordance with a second polarization, and said second polarization is orthogonal to said first polarization.

22. A multi-beam antenna as recited in claim 20, further comprising a polarization rotator located either between said at least one first antenna feed element and said selective element or between said at least one second antenna feed element and said selective element.

23. A multi-beam antenna as recited in claim 22, wherein said polarization rotator is located either between said at least one first antenna feed element and said first portion of said electromagnetic lens or said at least one second antenna feed element and said second portion of said electromagnetic lens.

24. A multi-beam antenna as recited in claim 22, wherein said polarization rotator is incorporated in either said first portion of said electromagnetic lens or said second portion of said electromagnetic lens.

25. A method of transmitting or receiving electromagnetic waves, comprising:

a. transmitting or receiving a first electromagnetic wave along a first direction through an first portion of an electromagnetic lens;

b. transmitting or receiving a second electromagnetic wave through a second portion of said electromagnetic lens; and c. reflecting a substantial portion of said second electromagnetic wave from a selective element in a region between said first and second portions of said electromagnetic lens, wherein the operations of transmitting or receiving a second electromagnetic wave through a second portion of said electromagnetic lens and reflecting said second electromagnetic wave from said selective element in said region between said first and second portions of said electromagnetic lens are adapted so that both said first and second electromagnetic waves propagate along a similar median direction within said second portion of said electromagnetic lens.

26. A method of transmitting or receiving electromagnetic waves as recited in claim 25, wherein a carrier frequency of said first electromagnetic wave is different from a carrier frequency of said second electromagnetic wave, and the operation of reflecting said second electromagnetic wave is responsive to a carrier frequency of said second electromagnetic wave.

27. A method of transmitting or receiving electromagnetic waves as recited in claim 25, wherein a polarization of said first electromagnetic wave is different from a polarization of said second electromagnetic wave, and the operation of reflecting said second electromagnetic wave is responsive to a polarization of said second electromagnetic wave.

* * * * *